US012679516B2

(12) United States Patent
Flower

(10) Patent No.: US 12,679,516 B2
(45) Date of Patent: Jul. 14, 2026

(54) BOAT LIFT

(71) Applicant: Kenneth F. Flower, Fremont, OH (US)

(72) Inventor: Kenneth F. Flower, Fremont, OH (US)

( * ) Notice: Subject to any disclaimer, the term of this patent is extended or adjusted under 35 U.S.C. 154(b) by 106 days.

(21) Appl. No.: 18/667,160

(22) Filed: May 17, 2024

(65) Prior Publication Data

US 2024/0383587 A1 Nov. 21, 2024

Related U.S. Application Data

(60) Provisional application No. 63/502,680, filed on May 17, 2023.

(51) Int. Cl.
*B63C 3/06* (2006.01)
*B63C 3/12* (2006.01)

(52) U.S. Cl.
CPC . *B63C 3/06* (2013.01); *B63C 3/12* (2013.01)

(58) Field of Classification Search
CPC ..... B63C 3/06; B63C 3/12; B66F 7/02
See application file for complete search history.

(56) References Cited

U.S. PATENT DOCUMENTS 3,025,984 A 3/1962 Hugo
5,482,401 A 1/1996 Spisak
5,655,850 A * 8/1997 Holmgren ..... B63C 1/02 405/1
6,230,639 B1 * 5/2001 Mclaughlin ..... B66F 7/02 405/3
6,554,533 B2 4/2003 Godbersen
7,059,803 B2 * 6/2006 Floe ..... B63C 3/06 114/44
8,777,513 B2 7/2014 Devitt
8,979,426 B2 3/2015 Doig
2015/0157566 A1 6/2015 Kim et al.
2020/0298946 A1 9/2020 Tiedge et al.
2022/0355909 A1 * 11/2022 Genovese ..... B66F 7/28

FOREIGN PATENT DOCUMENTS

KR 20060069068 A 6/2006
KR 101465734 B1 11/2014

* cited by examiner

*Primary Examiner* — Carib A Oquendo
(74) *Attorney, Agent, or Firm* — Jacob M. Ward; Ward Law Office LLC

(57) ABSTRACT

In some aspects, the techniques described herein relate to a boat lift system, including: a pair of lift frames, each of the lift frames disposed across longitudinally spaced apart pilings or support posts; a pair of lifting mechanisms, each one of the lifting mechanisms disposed in one of the lift frames, each of the lifting mechanisms including a ball screw mechanism, including a ball screw in communication with a motor and a ball nut, the ball screw mechanism configured to selectively wind a winch cable; and a lift platform in communication with the winch cable and configured to be selectively raised and lowered with the winch cable via the pair of lifting mechanisms.

20 Claims, 5 Drawing Sheets

BOAT LIFT

CROSS-REFERENCE TO RELATED APPLICATIONS

This application claims the benefit of U.S. Provisional Application No. 63/502,680, filed on May 17, 2023. The entire disclosure of the above application is incorporated herein by reference.

FIELD

The present technology relates to boat lifts, and more particularly, to boat lifts that reduce cable fatigue and improve durability and operation.

INTRODUCTION

This section provides background information related to the present disclosure which is not necessarily prior art.

Boat lifts currently designed for use with medium and larger size boats exhibit a number of shortcomings. Normally, such lifts feature a respective motor, winder, and independently driven cable system mounted to support posts or pilings on each longitudinal side of a boat. As a result, these mechanisms tend to be quite expensive and complicated. Installation is usually time consuming and labor intensive. Utilizing multiple motors is particularly costly and inefficient. Moreover, it is often quite difficult to accurately synchronize the operation of the multiple motors. The respective sides of the lift platform which supports the boat are apt to be raised or lowered at different rates. The lift platform is thereby likely to tilt during operation.

An embodiment of a four piling boat lift has eliminated independently operated cables and associated cable beams from respective longitudinal sides of the lift. This four piling boat lift instead employs a pair of motors and corresponding pulley assemblies mounted at the front and back ends of the boat lift. This boat lift continues to require a pair of motors, which are quite costly and inefficient. The boat lift also exhibits synchronization problems because of the use of multiple independent motors.

Multiple cable/multiple piling boat lifts can further experience problems associated with speed reduction and cable wear. The output of each motor can be reduced to provide an appropriate speed and torque for raising and lowering the lift. This can require the use of a fairly complex reduction system. Standard cable winders or drums also tend to cause difficulties. Cable winders can have a relatively small diameter, which can over-stress the cable as it is being wound onto or off of the winder. This can shorten the life of the cables, thereby requiring the cables to be replaced. Such repairs are costly and render the lift inoperable while they are being performed.

There is a continuing need for an improved boat lift system that reduces cable fatigue and stabilizes operation.

SUMMARY

In concordance with the instant disclosure, an improved boat lift system that reduces cable fatigue and stabilizes operation has surprisingly been discovered.

The boat lift system is designed to elevate and lower a boat or boat in an efficient and stable manner. The boat lift system can include a pair of lift frames strategically positioned across pilings or support posts. Each frame can house a lifting mechanism featuring a ball screw mechanism that includes a ball screw driven by a motor. The operation of the motor can be supported by batteries, which can be charged by solar panels. The ball screw mechanism can wind a winch cable that connects to a lift platform. The lift platform, equipped with cradle beams and bunk boards, can be designed to securely hold and support the boat during the lifting process, the ball screw mechanism configured to selectively move a winch cable.

A method of installing a boat lift system can include setting up a boat lift system that includes components such as lift frames, lifting mechanisms, and a lift platform. The process includes providing two sets of longitudinally spaced apart pilings or support posts, ensuring they are appropriately spaced. Each lift frame can be installed across these pilings, establishing a stable and robust framework necessary for the secure operation of the boat lift. This method facilitates a structured and efficient installation, accommodating various marine environments and ensuring the stability and functionality of the boat lift system.

A method for operating a boat lift system to lift a boat can include initially positioning the boat lift in a lowered state to allow placement of a boat on the lift platform. Once the boat is positioned, the motors within the lifting mechanisms can be activated. These motors drive the ball screws in the ball screw mechanisms, which in turn wind the winch cables to raise the lift platform and the boat. The operation can be monitored to ensure the boat remains stable and is lifted evenly to the desired height for maintenance, storage, or other purposes, providing a controlled and safe lifting process.

The ball screw can minimize the amount of cable used, which can decrease overall wear on the lifting mechanism. Additionally, the ball screw allows for the boat to be lifted more rapidly than with known boat lift devices. The present device can minimize the number of exposed elements, such as pulleys, which improve the safety of the device. The present device can also minimize the number of elements that are submerged in operation over known devices. The present device can also minimize cable fatigue compared to known boat lifting devices.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
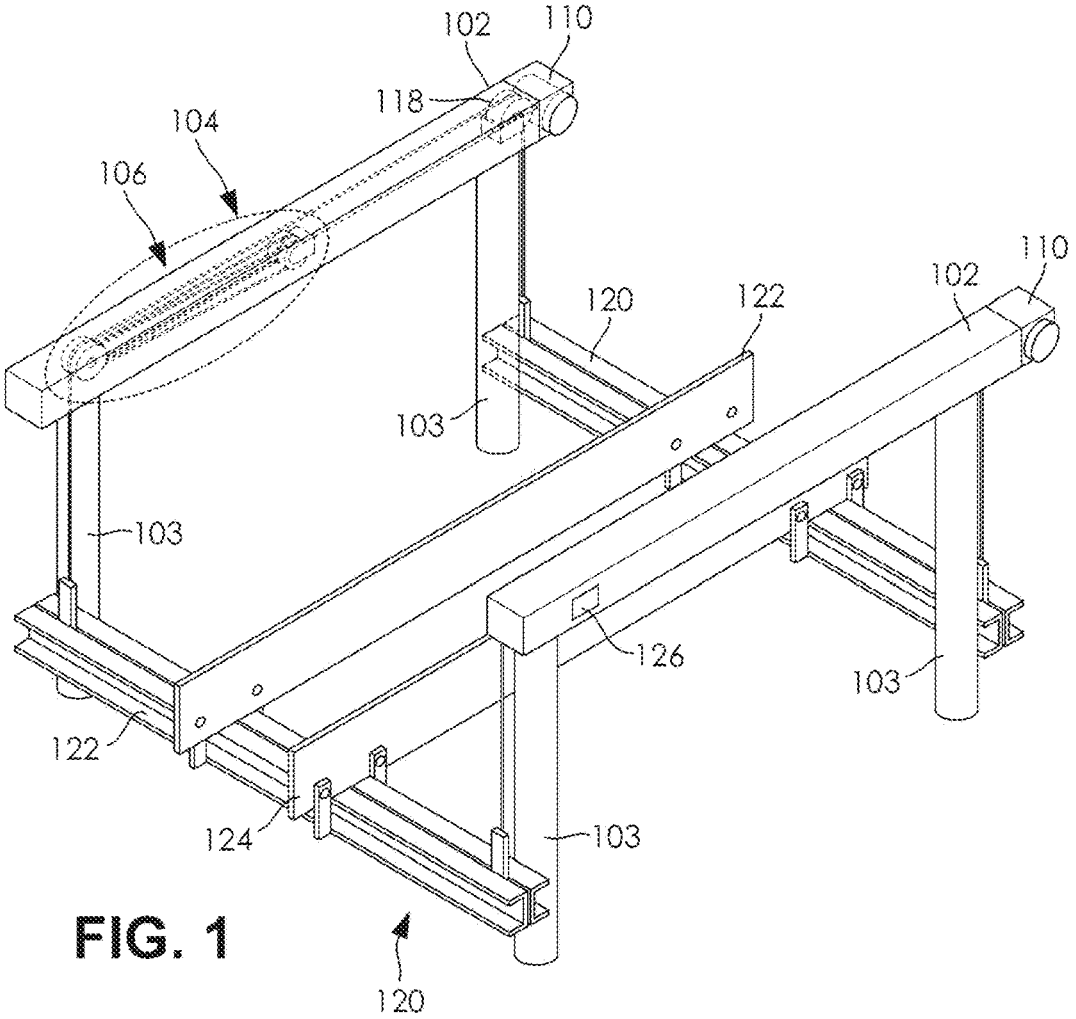
FIG. 1 is a top perspective view of a boat lift system according to an embodiment of the present disclosure.
Figure 2:
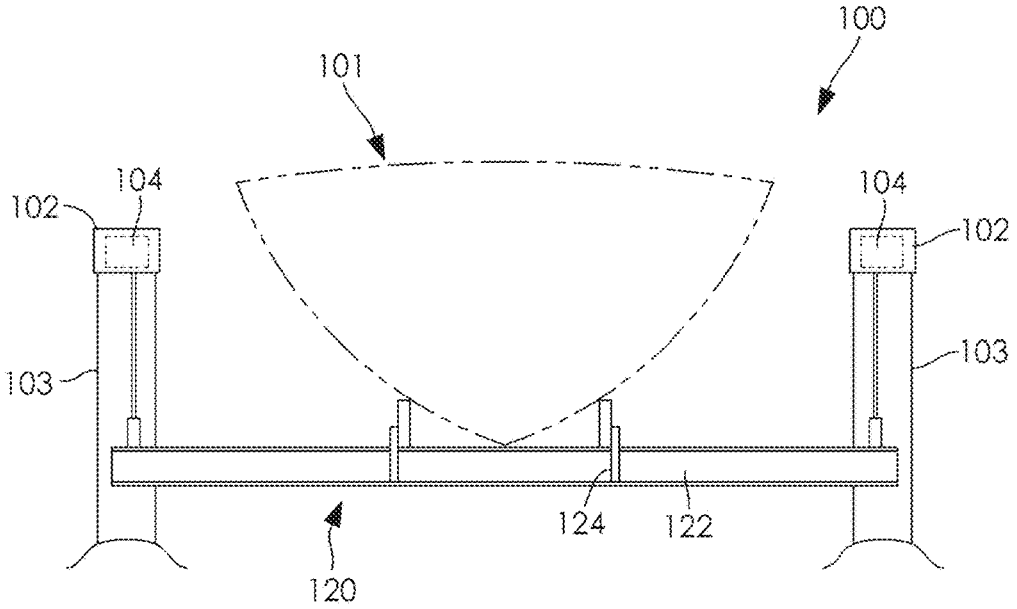
FIG. 2 is a front elevational view of the boat lift of FIG. 1.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/of" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

An embodiment of a boat lift system constructed in accordance with the present disclosure is shown in FIG. 1. The boat lift system can be employed to selectively raise and lower a boat, out of and into a body of water. It should be understood that the boat lift system can be utilized for virtually all types of boats and other watercraft. The boat lift system can be located proximate a dock, pier, seawall, or other structure bordering a boat slip or storage space. The boat lift system can be suitable for use in virtually any body of water in which a boat lift is normally employed. In certain embodiments, the boat lift system can be utilized with existing piling structures, as described in greater detail herein.

The boat lift system can include a pair of lift frames. Each one of the lift frames can be disposed across longitudinally spaced apart pilings or support posts, which are arranged beside the dock, pier, or sea wall. Each one of the lift frames can be disposed across a pair of longitudinally spaced pilings. However, a skilled artisan can select a suitable number of the longitudinally spaced apart pilings based on a length of the boat to be lifted. For example, a longer boat may require that the lift frames span three or four longitudinally spaced pilings in order to accommodate the length of the boat. The lift frames can be space apart and disposed parallel to one another. A distance between the lift frames can be determined based on a width of the boat to be lifted. A skilled artisan can utilize necessary dimensions for the lift frames within the scope of the present disclosure.

The boat lift system can be configured to be utilized with existing pilings, offering a versatile and adaptable installation process. This configuration can allow the lift frames of the boat lift system to be disposed across longitudinally spaced apart pilings or support posts that are already in place. By utilizing existing infrastructure, the system can minimize the need for new construction and reduce the overall environmental impact. The adaptability of the lift system can enable it to accommodate various distances between existing pilings, making it suitable for a wide range of locations and settings. This feature can be particularly beneficial in areas where marine construction permits are restricted or where preserving the existing landscape is a priority. The ability to integrate seamlessly with preexisting pilings can enhance the utility and applicability of the boat lift system, making it an ideal choice for many waterfront properties.

The lift frames can be in communication with a lift platform. The lift platform is operably (e.g., vertically movably) mounted to the support pilings. The lift platform can include a pair of generally parallel cradle beams that are configured to extend beneath a boat or boat and can be arranged transversely to the axis of the boat. The lift platform can include a parallel pair of bunk boards that extend transversely across and are mounted to an upper surfaces of cradle beams. The bunk boards can extend generally longitudinally relative to the accommodated the boat or boat. The bunk boards typically can include wood or appropriate synthetic material. They can be bolted or otherwise secured to the cradle beams in a known manner. When the boat is mounted on the lift, it sits on the bunk boards.

In the construction of the boat lift boat lift system, a variety of materials can be employed, each selected for specific properties to enhance the performance of the boat lift system in marine environments. For example, the primary structural components such as lift frames and beams can be fabricated from aluminum or aluminum alloys. These alloys are chosen for their strength-to-weight ratio and superior corrosion resistance, which can improve structural integrity and appearance under both freshwater and saltwater conditions. It should be noted that the use of aluminum alloys is intended as an example, and other corrosion-resistant materials can also be utilized depending on specific design requirements and environmental conditions.

Load-bearing components including screws, bolts, and cable attachments can be made from stainless steel. Stainless steel is selected for its high strength and exceptional resistance to rust and corrosion, ensuring that the boat lift can maintain its functionality and safety under high stress and adverse weather conditions. The choice of stainless steel is illustrative, and alternative durable materials that offer similar benefits can also be employed.

For enhancing the durability and reducing the weight of certain parts, such as bunk boards and pulleys, reinforced composite materials can be used. Composite materials can include fiberglass or carbon fiber combined with a polymer matrix, provide high tensile strength and fatigue resistance. The lightweight nature of composite materials can reduce the overall load on the lifting mechanism and offer resistance to environmental factors such as UV light and saltwater exposure. Other lightweight and durable composite materials can also be suitable.

Areas of the boat lift that require human interaction, including platforms and control handles, can be covered with non-slip synthetic rubber. This material is chosen not only for its grip and comfort but also for its ability to withstand various temperatures and exposure to water, making it ideal for ensuring operator safety and ease of use. The application of non-slip synthetic rubber is provided as an example, and other non-slip, durable materials can also be used based on specific operational needs.

Metal components of the boat lift can be treated with corrosion-resistant coatings. These coatings, which include examples such as epoxy or zinc-rich primers, can be applied using techniques that ensure uniform coverage and strong adhesion. This additional protective layer can extend the maintenance intervals for the boat lift and help in preserving both its structural and aesthetic qualities. The use of these corrosion-resistant coatings is illustrative, and other effective corrosion-resistant treatments can be considered.

The lift frames can each house a lifting mechanism. The lifting mechanism can be in communication with the lift platform, as described herein. The lift mechanism can selectively move the lift platform, including raising and lowering the lift platform. The lifting mechanism can include a ball screw mechanism. The ball screw lift mechanism can convert rotational motion into linear motion with high efficiency and precision, making it particularly advantageous for applications such as boat lifts where controlled, smooth, and reliable lifting and lowering of substantial loads are required.

The components of the ball screw lift can include the ball screw, which is a cylindrical rod featuring helical threads, and the ball nut, which is configured to traverse a length of the ball screw upon rotation of the ball screw. The ball nut can contain internal threads that match those of the screw and can house ball bearings that facilitate movement of the ball nut. The ball bearings can reduce friction between the moving parts, enhancing the efficiency of the ball screw lift and extending its operational lifespan. The ball screw can threaded and can be threadedly engaged with the ball nut, allowing the ball nut to move along its length in either direction, depending on the direction of rotation of the ball screw. The ball nut can be in communication with a pulley. The ball screw can pass through or be disposed adjacent the pulley. When the ball nut moves along a length of the ball screw, the ball nut can likewise move the pulley along the length of the ball screw.

A motor can be coupled to the ball screw to initiate rotational motion of the ball screw. The ball screw can be affixed to a winch cable, which translates the rotational motion into the vertical movement of the lift platform. The motor imparts rotational motion to the ball screw, and the direction of rotation of the motor dictates whether the lift platform will ascend or descend. The ball screw is capable of rotating in either direction, which enables the lifting mechanism to either raise or lower the lift platform.

At each end of the lift frame, a pulley can be installed to guide and redirect the winch cable. Each pulley can be fully enclosed within the lift frame, which serves to protect the pulley from external elements, prevent contact therewith, and provide a cleaner and more integrated appearance to the lift system. The winch cable can extend from the motor-driven ball screw, pass over the enclosed pulley, and then connect to the cradle beams.

The winch cable can attach to the cradle beams at designated connection points to distribute the load evenly and reduce stress concentrations. The winch cable can be attached directly to the cradle beams without the use of pulleys, reducing the number of moving parts and potential failure points, especially under the waterline where corrosion and biofouling can occur.

The boat lift system can include a control mechanism that allows for synchronized operation of the dual lift mechanisms, ensuring that the boat is lifted evenly and stability is maintained. One option can include individual buttons for each lift mechanism, configured such that pressing both buttons simultaneously will activate both lifting mechanisms. This set up can allow an operator to have direct control over each mechanism but requires synchronization by the operator to ensure both lifting mechanisms operate in unison. This method can be particularly useful in scenarios where precise manual control, including independent control of the lifting mechanisms, is temporarily needed before full synchronization of the lifting mechanisms.

Alternatively, the control mechanism can include a single button that, when pressed, simultaneously actuates both lifting mechanisms. This design can simplifies operation, reducing the potential for human error by ensuring that both lifting mechanisms are always activated at the same time. The single-button system can be ideal for routine operations where simplicity and speed are prioritized.

The control mechanism can also support remote-control actuation. This feature can allow an operator to activate the lifting mechanisms from a distance, enhancing convenience and safety. The remote-control actuation can be designed to communicate with the control system of the boat lift via secure wireless signals, ensuring that the lifting mechanisms are activated simultaneously even when the operator is not physically at the control panel. This remote capability can be particularly advantageous in large marinas or private docks where direct access to the control panel is not always practical.

Control mechanisms of the boat lift can be integrated into the boat lift system through the use of a central processing unit of the control mechanism, which can ensure synchronized operation of the lifting mechanisms. The central processing unit can process input from any of the control methods—whether dual buttons, a single button, or remote control—and translate it into synchronized activation of both lifting mechanisms. The central processing unit can also be programmed to include safety checks and balances that prevent the lift from operating if synchronization is compromised, thereby enhancing the overall performance of the system. Other embodiments can also include remote control capabilities, allowing for operation from a distance. The boat lift system can also include sensors and software algorithms that monitor the status and alignment of the boat lift in real-time while in communication with the central processing unit. The control mechanism can include a user interface with a display that can provide real-time feedback on the status of the lift operation, including the current height of the lift platform and the operational status of the motors. The control mechanism can include programmable settings that allow the user to set specific heights for the lift platform to stop automatically. The control mechanism can be configured to receive signals from a water level monitoring system to adjust the height of the lift platform based on changes in water level.

The motor of the boat lift system can be electric or hydraulic as non-limiting examples. Electric motors can be utilized due to their reliability and ease of control. The motor can be directly or indirectly in communication with the ball screw. The motor of the boat lift system can be in electrical communication with one or more batteries located on a proximate dock, facilitating a reliable and efficient power supply. The batteries can serve as the primary energy source for the motor, ensuring that the boat lift operates smoothly and consistently. By utilizing batteries, the system can maintain functionality even in the absence of direct electrical connections, enhancing its versatility and usability in various marine environments. As a non-limiting example, the batteries can be lithium ion batteries.

The batteries can be configured to be trickle charged from existing electrical infrastructure on the dock. This setup can allow the batteries to continuously receive a small amount of power, sufficient to keep them fully charged over time without overcharging or damaging the batteries. Trickle charging can be an effective way to ensure that the boat lift is always ready for operation, providing convenience and reliability to the boat owners.

Alternatively, the batteries can also be charged using a separate charger specifically designed for this purpose. This charger can be tailored to the specific needs and specifications of the batteries used in the boat lift system, optimizing the charging process and enhancing the overall efficiency of the system. The use of a dedicated charger can help maintain the health and longevity of the batteries, ensuring they provide stable and reliable power to the boat lift motor. Moreover, the charger used for the batteries can be compatible with solar panels, allowing for an eco-friendly charging solution. By harnessing solar energy, the boat lift system can operate on renewable energy, reducing its environmental impact and potentially lowering operational costs. Solar panels can be installed on the dock or nearby structures, capturing solar energy during the day and converting it to electrical power stored in the batteries.

A method for installing a boat lift can include several steps to ensure proper setup and functionality. Initially, the method can involve providing a boat lift system that includes a pair of lift frames. Each lift frame can be disposed across longitudinally spaced apart pilings or support posts. Additionally, the method can include providing two sets of two longitudinally spaced apart pilings or support posts, where each set is appropriately spaced apart for the particular boat lift application. The installation method can include installing one of the lift frames across one set of the longitudinally spaced apart pilings or support posts. Similarly, another lift frame can be installed across the other set of longitudinally spaced apart pilings or support posts. This arrangement can ensure that the lift frames are properly aligned and secured for stable operation. Furthermore, the method can include an optional step of installing the two sets of longitudinally spaced apart pilings or support posts near a dock or seawall, providing convenient access and structural support. In scenarios where the pilings or support posts are preexisting, the method can adapt to utilize these existing structures, enhancing the integration of the boat lift system with the current marine environment.

A method for lifting a boat using a boat lift mechanism can involve several operational steps to raise and lower a boat. The method can include ensuring that the boat lift is in a fully lowered position, facilitating easy placement of the boat. The boat can be carefully positioned over a lift platform that is integral to the boat lift system. This platform can include a pair of generally parallel cradle beams configured to extend transversely beneath the boat. Once the boat is positioned, the method can include activating motors associated with a pair of ball screw mechanisms housed within the lift frames. Each ball screw mechanism can include a ball screw in communication with the respective motor and a ball nut configured to selectively wind a winch cable. Activation of the motors can cause the ball screws to rotate, engaging the ball nuts which can be threadedly engaged with the ball screws. This engagement can cause the ball nuts to move along a length of the ball screws, pulling the winch cables and raising the lift platform along with the boat positioned on the lift platform. The motors can also be reversed, causing the ball nuts to move along a length of the ball screws in a reverse direction, letting out the winch cables and lowering the lift platform along with the boat positioned on the platform.

The method can include monitoring the lifting process to ensure that the boat remains stable and that the lift platform is evenly raised or lowered. The lift platform can be continued until the boat reaches a desired height above the water for maintenance, storage, or other purposes. Once a predetermined raised height is achieved, the motors can be deactivated, securing the boat in an elevated position. Alternatively, once a predetermined lowered height is achieved, the motors can be deactivated, securing the boat in an lowered position, including where the boat is floating freely from the lifting platform. This method allows for a controlled and safe operation of lifting and/or lowering a boat using a boat lift system, ensuring that the boat is secure throughout the raising and/or lowering operation(s).

It should be appreciated that the present technology can provide improved performance and cable durability over certain other boat lifts. The use of a ball screw mechanism can improve the longevity of the winch cable by reducing cable fatigue. The use of a ball screw can likewise improve the speed at which the boat is raised or lowered, in operation.

EXAMPLES

Example embodiments of the present technology are provided with reference to the several figures enclosed herewith.

With reference to FIGS. 1-4, an embodiment of a boat lift system 100 is shown. The boat lift system 100 is configured to facilitate the lifting and lowering of a boat 101. In the embodiment depicted, the boat lift system 100 can include two lift frames 102, which can be positioned across pilings or support posts 103. These lift frames 102 serve as the primary structural support for the lifting mechanisms 104 housed within each of the lift frames 102. Each lifting mechanism 104 can include a ball screw mechanism 106, which includes a ball screw 108. The ball screw 108 is driven by a motor 110. Operation of the motor is supported by batteries (not shown), which provide a reliable power source, and can be sustainably charged by solar panels (not shown) installed to be in electrical communication the system 100.

Figure 3:
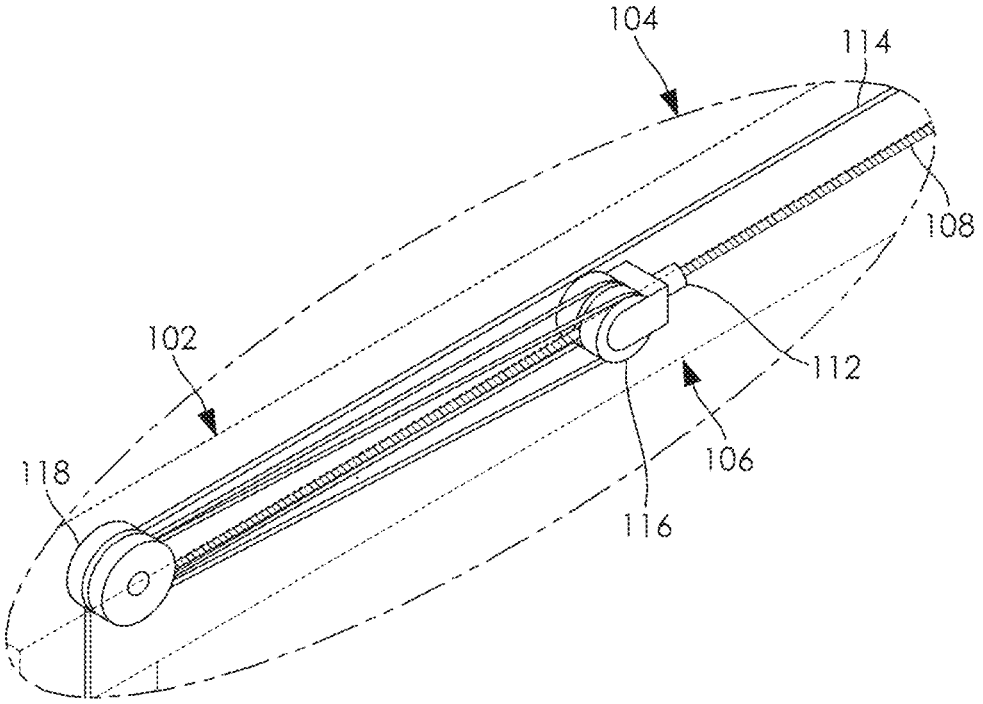
FIG. 3 is an enlarged, partial cutaway view of a lifting mechanism of the boat lift system taken at the callout in FIG. 1.

With specific reference to FIG. 3, the ball screw mechanism 106 can include the ball screw 108, a ball nut 112, a winch cable 114, a lift pulley 116, and guide pulleys 118. The ball nut 112 can be disposed on the ball screw 108. The winch cable 114 can be in communication with the ball screw 108. The ball nut 112 can be in communication with the lift pulley 116. In the embodiment depicted, the ball screw 108 can pass through the lift pulley 116. When the ball nut 112 moves along the ball screw 108, it can likewise move the lift pulley 116 along the length of the ball screw 108, where movement of the ball nut 112 can be bidirectional to raise/lower the boat 101. At each end of the lift frame 102, the guide pulley 118 can be installed to guide and redirect the winch cable 114. Each guide pulley 118 can be fully enclosed within the lift frame 102, which serves to protect the guide pulleys 118 from external elements, prevent contact therewith, and provide a cleaner and more integrated appearance to the boat lift system 100.

The winch cable 114 can extend from the lifting mechanism 104, pass over the guide pulleys 118, and then connect to the lift platform 120, which includes cradle beams 122 that provide foundational support and bunk boards 124 that offer a stable resting surface for the boat 101. The winch cable 114 can attach to the cradle beams 122 at designated connection points, for example, at each corner of the lift platform 120.

Figure 4A:
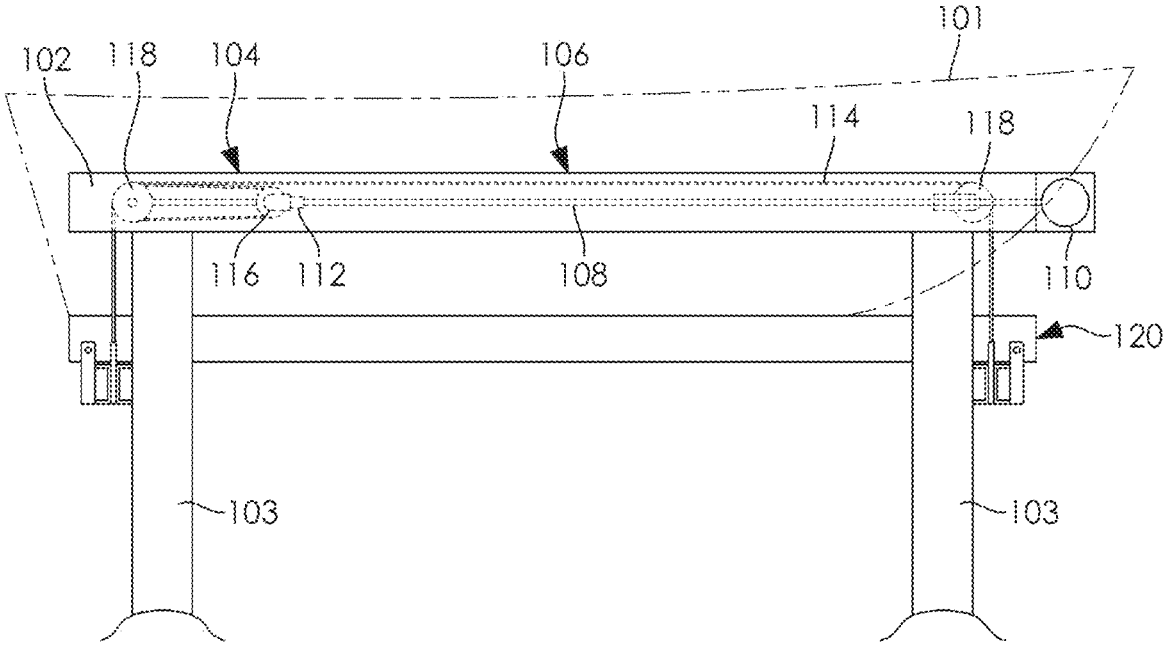
FIGS. 4A-4C are side elevational views of the boat lift system, depicting a stepwise movement of a boat on the boat lift according to one embodiment of the present disclosure.
Figure 4B:
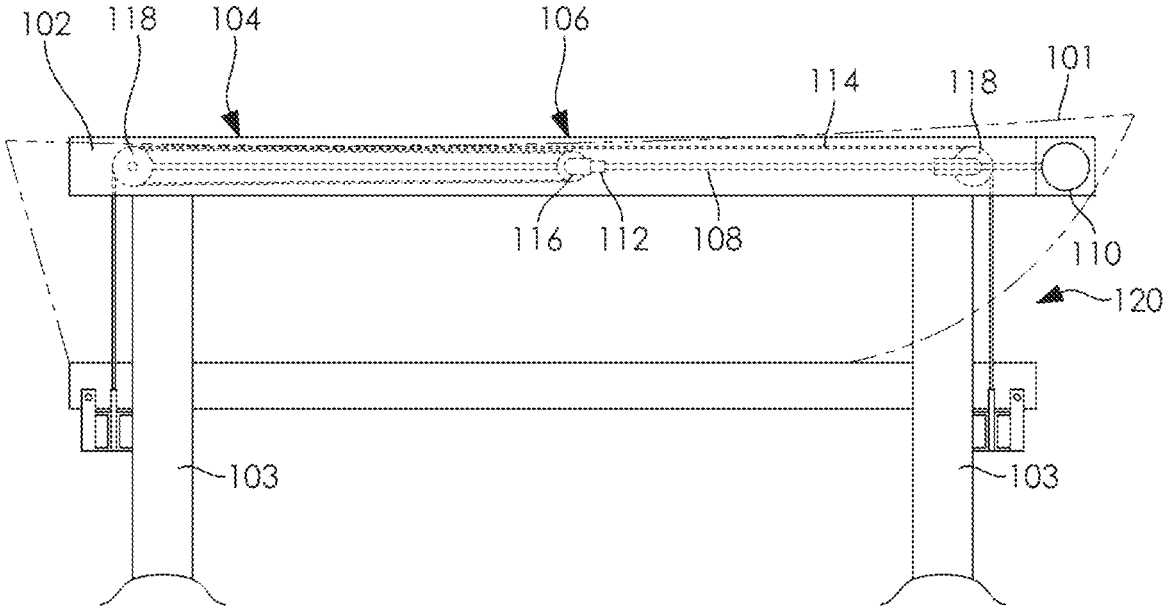
Figure 4C:
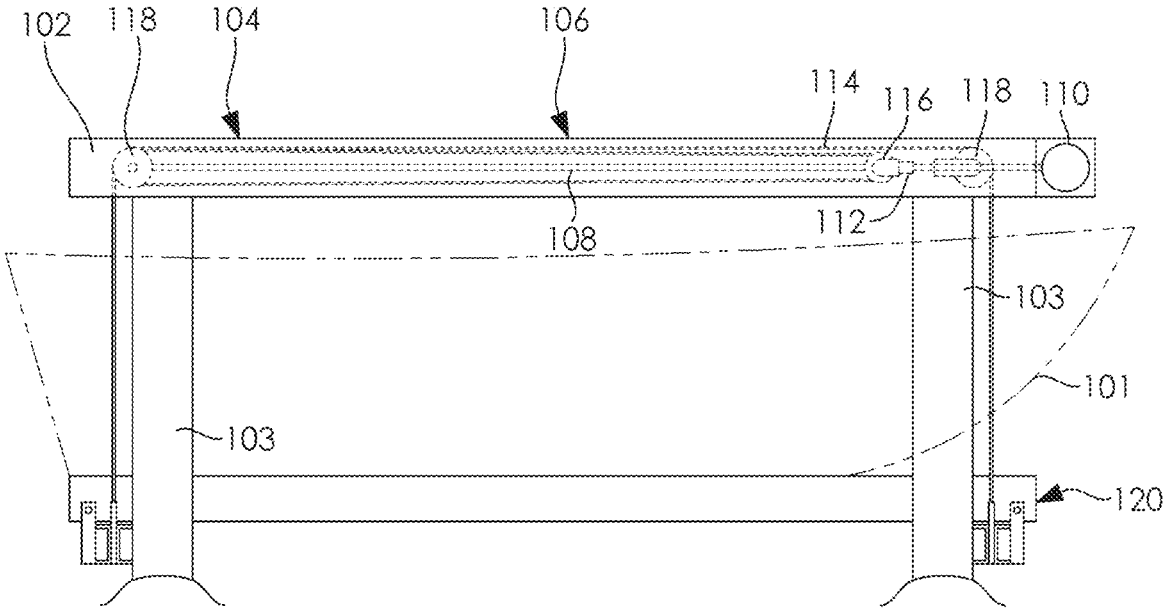

In operation, for example, as shown in FIGS. 4A-4C, a user can activate a control system 126. The control system can actuate the motor 110, which can turn the ball screw 108. As the ball screw 108 rotates, the ball nut 112 and associated lift pulley 116 travel along the ball screw 108. The movement of the ball nut 112 and the lift pulley 116 can move the winch cable 114. The movement of the winch cable 114 can raise or lower the lift platform 120. As shown in the series of FIGS. 4A-4C, the boat 101 is shown in a raised position (FIG. 4A), an intermediate position (FIG. 4B), and a lowered position (FIG. 4C).

Figure 5:
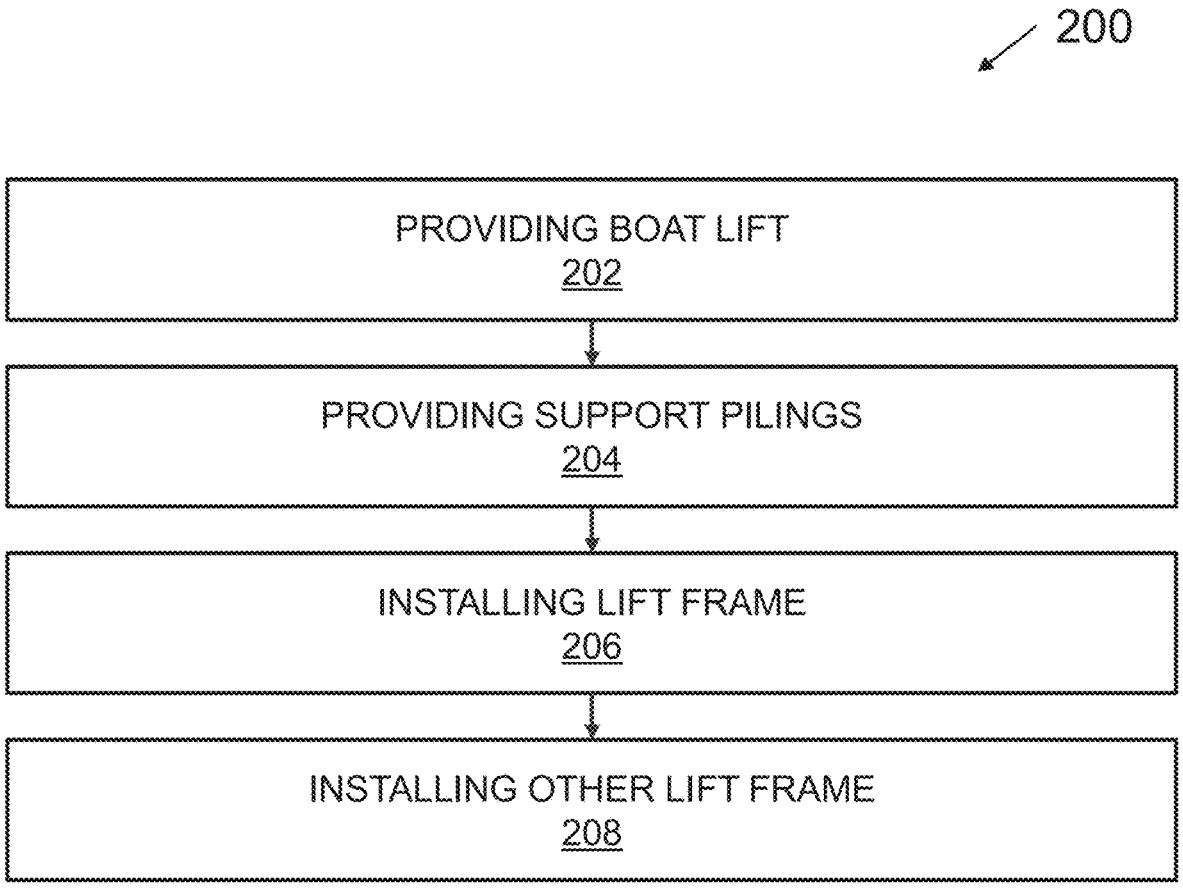
FIG. 5 is a flow chart depicting a method of installing the boat lift system according to an embodiment of the present disclosure.

With reference to FIG. 5, a flowchart depicting a method 200 of installing a boat lift system 100 is shown. The method 200 can include a step 202 of providing the boat lift system 100 as described herein. The method 200 can include a step 204 of providing two sets of two longitudinally spaced apart pilings or support posts 103. The method 200 can include a step 206 installing one of the lift frames 102 across one of the sets of the longitudinally spaced apart pilings or support posts 103 and another one of the lift frames 102 across the other one of the longitudinally spaced apart pilings or support posts 103.

Figure 6:
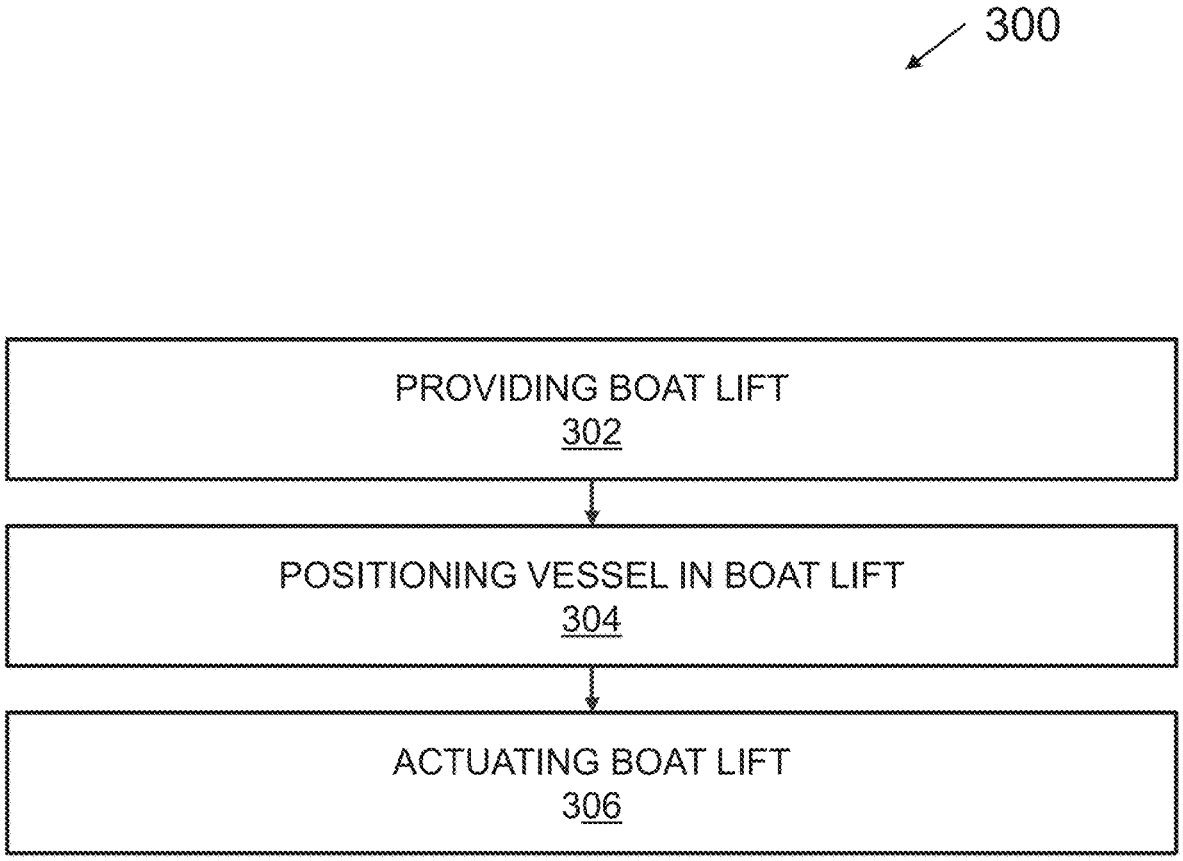
FIG. 6 is a flow chart depicting a method of operating the boat lift system according to an embodiment of the present disclosure.

With reference to FIG. 6, a flowchart depicting a method 300 of utilizing a boat lift system 100 is shown. The method 300 can include a step 302 of providing the boat lift system 100 as described herein. The method 300 can include a step 304 of positioning a boat 101 within the boat lift system 100. The method 300 can include a step 306 of actuating the boat lift thereby placing the boat in an elevated position for maintenance, storage, or other purposes. The method 300 can also include the reverse of step 306, where actuating the boat lift system 100 results in lowering the boat 101 from a raised position to a lowered position, where the lift platform 120 can be lowered below the boat 101 so that the boat 101 is floating and no longer in contact with the lift platform 120.

The boat lift system presented herein addresses shortcomings of other boat lifts by offering a streamlined, cost-effective, and efficient solution. Certain boat lifts often suffer from high costs, complex installations, and synchronization issues due to their use of multiple motors and independently operated cable systems. The boat lift system provided by the present disclosure simplifies the structure by employing a ball screw mechanism in each lift frame, which not only reduces the number of motors required but also minimizes cable wear and enhances synchronization. The integration of ball screws with motors and a winch cable system facilitates a more uniform lifting process, preventing tilting issues associated with asynchronous lifting by other boat lifts. Moreover, the use of durable materials and the option to power the system through eco-friendly solar-charged batteries further enhances the operational efficiency and sustainability of the lift.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A boat lift system for raising and lowering a boat, comprising:

a pair of lift frames, each of the lift frames configured to be disposed across longitudinally spaced apart pilings;

a lift platform configured to be selectively raised and lowered; and a lifting mechanism disposed in each of the lift frames, the lifting mechanism including a ball screw mechanism having a ball screw rotationally coupled to a motor, a ball nut, and a winch cable coupling the ball nut to the lift platform, the winch cable directly connected at two points on the lift platform, wherein movement of the winch cable via the ball screw mechanism is operable to selectively raise and lower the lift platform.

2. The boat lift system of claim 1, wherein each of the lift frames is disposed across two longitudinally spaced apart pilings or support posts.

3. The boat lift system of claim 1, wherein the lift frames are disposed parallel to one another, and a distance between the lift frames is based on a width of the boat.

4. The boat lift system of claim 1, further comprising cradle beams that include bunk boards that extend longitudinally relative to a length of the boat.

5. The boat lift system of claim 1, wherein the ball screw mechanism is configured to convert rotational motion into linear motion to facilitate the raising and lowering of the lift platform.

6. The boat lift system of claim 1, wherein the ball screw in the lifting mechanism is rotationally coupled to a motor selected from the group consisting of an electric motor and a hydraulic motor.

7. The boat lift system of claim 1, wherein the motor is in electrical communication with a battery located on a proximate dock, and the battery is configured to power the motor.

8. The boat lift system of claim 7, wherein the battery is configured to be trickle charged from a preexisting electrical infrastructure on the proximate dock, thereby ensuring that the battery is continuously maintained at about full charge without overcharging.

9. The boat lift system of claim 7, wherein the battery is electrically coupled to a solar panel configured to charge the battery.

10. The boat lift system of claim 9, wherein the solar panel is installed the proximate dock.

11. The boat lift system of claim 1, wherein the winch cable is in communication with the ball screw and configured to translate a rotational motion of the ball screw into vertical movement of the lift platform.

12. The boat lift system of claim 1, wherein the motor of each lifting mechanism is actuated by a controller.

13. The boat lift system of claim 12, wherein the controller includes a switch located proximate to the boat lift system, the switch operable to actuate the motor of each lifting mechanism.

14. The boat lift system of claim 1, wherein the lift mechanism includes a pulley at each end of the lift frame fully enclosed within the lift frame.

15. The boat lift system of claim 1, wherein the lift frame is fabricated from aluminum or aluminum alloys.

16. The boat lift system of claim 1, wherein the motors are separably operable.

17. The boat lift system of claim 1, wherein the ball nut is in communication with a lift pulley, and wherein the lift pulley is configured to move along the ball screw with the ball nut.

18. The boat lift system of claim 1, wherein the winch cable is directly connected at two corners of the lift platform.

19. A method of installing a boat lift for raising and lowering a boat, comprising:

providing a boat lift system including:

a pair of lift frames, each of the lift frames configured to be disposed across longitudinally spaced apart pilings;

a lift platform configured to be selectively raised and lowered; and a lifting mechanism disposed in each of the lift frames, the lifting mechanism including a ball screw mechanism having a ball screw rotationally coupled to a motor, a ball nut, and a winch cable coupling the ball nut to the lift platform, the winch cable directly connected at two points on the lift platform, wherein movement of the winch cable via the ball screw mechanism is operable to selectively raise and lower the lift platform;

providing two sets of two longitudinally spaced apart pilings or support posts wherein the each of the sets are spaced apart;

installing one of the lift frames across one of the sets of the longitudinally spaced apart pilings or support posts and another one of the lift frames across the other one of the longitudinally spaced apart pilings or support posts.

20. A method of using a boat lift for raising and lowering a boat, comprising:

providing a boat lift system in a lowered position, the boat lift including:

a pair of lift frames, each of the lift frames configured to be disposed across longitudinally spaced apart pilings;

a lift platform configured to be selectively raised and lowered; and a lifting mechanism disposed in each of the lift frames, the lifting mechanism including a ball screw mechanism having a ball screw rotationally coupled to a motor, a ball nut, and a winch cable coupling the ball nut to the lift platform, the winch cable directly connected at two points on the lift platform, wherein movement of the winch cable via the ball screw mechanism is operable to selectively raise and lower the lift platform;

positioning a boat within the boat lift; and actuating the boat lift, thereby placing the boat in an elevated position for maintenance, storage, or other purposes.

* * * * *